US010531997B2

(12) United States Patent
Roleder et al.

(10) Patent No.: US 10,531,997 B2
(45) Date of Patent: Jan. 14, 2020

(54) LEG ASSEMBLY FOR A MASSAGE TABLE

(71) Applicant: EARTHLITE, LLC, Vista, CA (US)

(72) Inventors: Jon Roleder, San Diego, CA (US); Nicolas Padagas, Carlsbad, CA (US)

(73) Assignee: EARTHLITE, LLC, Vista, CA (US)

( * ) Notice: Subject to any disclaimer, the term of this patent is extended or adjusted under 35 U.S.C. 154(b) by 289 days.

(21) Appl. No.: 15/464,262

(22) Filed: Mar. 20, 2017

(65) Prior Publication Data

US 2017/0266073 A1 Sep. 21, 2017

Related U.S. Application Data

(60) Provisional application No. 62/311,135, filed on Mar. 21, 2016.

(51) Int. Cl.
*A61G 13/06* (2006.01)
*A61G 13/00* (2006.01)

(52) U.S. Cl.
CPC ..... *A61G 13/06* (2013.01); *A61G 13/009* (2013.01)

(58) Field of Classification Search
CPC .... A47C 19/045; A61G 1/0567; A61G 7/012; A61G 13/009; A61G 13/06; A47B 9/00; A47B 9/10; A47B 2200/004; A47B 2200/0062; A47B 2200/0063
See application file for complete search history.

(56) References Cited

U.S. PATENT DOCUMENTS 2,501,001 A * 3/1950 Neely ..... B66F 7/065 182/141
4,556,198 A * 12/1985 Tominaga ..... A61G 7/012 254/122
4,953,243 A * 9/1990 Birkmann ..... A61G 7/018 5/600
5,022,105 A * 6/1991 Catoe ..... A61G 1/0567 296/20
2005/0091747 A1* 5/2005 Freeborn ..... A61G 7/012 5/611
2009/0039666 A1* 2/2009 Lambarth ..... A61G 1/048 296/20

(Continued)

FOREIGN PATENT DOCUMENTS

DE 29612254 U1 * 9/1996 ..... A47C 19/045
EP 1138226 A2 * 10/2001 ..... A47C 19/128
FR 2788967 A1 * 8/2000 ..... A61G 13/009

*Primary Examiner* — Nicholas F Polito
(74) *Attorney, Agent, or Firm* — Roeder & Broder LLP; Steven G. Roeder

(57) ABSTRACT

A massage device includes a leg assembly that extends between a table top assembly and a surface. The leg assembly includes a first leg and a second leg that are coupled to one another. The first leg includes a first leg top that is coupled to the table top assembly, a first leg bottom that is positioned adjacent to the surface, and a first leg body that extends between the first leg top and the first leg bottom. The second leg includes a second leg top that is coupled to the table top assembly, a second leg bottom that is positioned adjacent to the surface, and a second leg body that extends between the second leg top and the second leg bottom. The second leg bottom includes a pair of fork members that are coupled to the second leg body, the fork members being positioned relative to one another to provide a pair of spaced apart contact points along the surface.

19 Claims, 4 Drawing Sheets

(56) References Cited

U.S. PATENT DOCUMENTS

| | | | | |
|---|---|---|---|---|
| 2009/0211026 | A1* | 8/2009 | Schoff | A61G 1/04 5/600 |
| 2010/0050343 | A1* | 3/2010 | Hornbach | A61G 7/012 5/611 |
| 2012/0060291 | A1* | 3/2012 | Gamman | A61G 13/009 5/611 |
| 2012/0167299 | A1* | 7/2012 | Tarquinio | A47C 19/045 5/93.1 |
| 2015/0135439 | A1* | 5/2015 | G. | A61G 7/012 5/611 |

* cited by examiner

LEG ASSEMBLY FOR A MASSAGE TABLE

RELATED APPLICATION

This application claims priority on U.S. Provisional Application Ser. No. 62/311,135, filed on Mar. 21, 2016 and entitled "LEG ASSEMBLY FOR A MASSAGE TABLE". As far as permitted, the contents of U.S. Provisional Application Ser. No. 62/311,135 are incorporated herein by reference.

BACKGROUND

As the benefits of therapeutic treatments such as therapeutic massage, facial treatments and/or other related treatments are becoming more widely appreciated, more and more people are participating in such therapeutic treatments. A typical massage table allows the patient to be resting while receiving a massage or other such treatment. Important features for massage tables include high strength in the lateral and vertical directions, light weight, quiet operation, stability, rigidity, and ease and speed of set-up and adjustment, and ease and comfort of use for both the person receiving the therapeutic treatment and the person administering the therapeutic treatment.

SUMMARY

The present invention is directed to a massage device including a table top assembly that supports a user above a surface. In certain embodiments, the massage device includes a leg assembly that extends between the table top assembly and the surface, and that supports the table top assembly relative to the surface. The leg assembly includes a first leg and a second leg that are coupled to one another. The first leg includes a first leg top that is coupled to the table top assembly, a first leg bottom that is positioned adjacent to the surface, and a first leg body that extends between the first leg top and the first leg bottom. Additionally, the second leg includes a second leg top that is coupled to the table top assembly, a second leg bottom that is positioned adjacent to the surface, and a second leg body that extends between the second leg top and the second leg bottom. Further, the second leg bottom includes a pair of fork members that are coupled to the second leg body, the fork members being positioned relative to one another to provide a pair of spaced apart contact points along the surface. Still further, the fork members have a fork length that is at least approximately five inches.

In some embodiments, the fork members extend at an angle of between approximately zero degrees and forty-five degrees relative to the second body member.

Additionally, in certain embodiments, the second leg bottom further includes a second cross member that is connected to the second leg body. In such embodiments, the pair of fork members can be spaced apart from one another and can extend away from the second cross member near either end of the second cross member. Further, the pair of fork members can extend away from the second cross member at an angle of between approximately seventy-five degrees and one hundred five degrees. In one such embodiment, the pair of fork members extend away from the second cross member at an angle of approximately ninety degrees.

Additionally, the second leg bottom can further include a pair of base members, with one base member being coupled to each of the fork members at a distal end of the fork member. In certain embodiments, each of the base members is substantially disc-shaped to maintain a static contact point between the second leg and the surface.

Further, in some embodiments, the first leg body includes a first leg aperture, and the second leg body includes a second leg aperture, and the leg assembly further includes a leg attacher that extends through the first leg aperture and the second leg aperture to couple the first leg and the second leg to one another. In some such embodiments, the leg attacher can movingly couple the first leg and the second leg to one another.

In various embodiments, the table top assembly is configured to move between a first position and a second position relative to the surface. In such embodiments, at least one of the legs is movingly coupled to the table top assembly, and at least one of the legs is configured to move relative to the surface when the table top assembly moves between the first position and the second position.

The massage device can further include an adjuster assembly that adjusts the position of the table top assembly relative to the surface between the first position and the second position. In certain embodiments, the adjuster assembly includes an adjuster that is coupled to and extends between the first leg and the second leg. Additionally, the adjuster can be an actuator that utilizes piston-like movement to move the table top assembly between the first position and the second position. Further, the massage device can also include a first adjuster connector that movably couples a first adjuster end of the adjuster to the first leg, and a second adjuster connector that movably couples a second adjuster end of the adjuster to the second leg. In some such embodiments, the first adjuster connector enables a first angle of the adjuster to change relative to the first leg during movement between the first position and the second position, and the second adjuster connector enables a second angle of the adjuster to change relative to the second leg during movement between the first position and the second position.

In some embodiments, the adjuster assembly can further include an adjuster frame that is coupled to and positioned adjacent to the table top assembly. Additionally, in certain embodiments, the leg assembly includes a first leg attacher that attaches the first leg to the adjuster frame, and a second leg attacher that attaches the second leg to the adjuster frame. In such embodiments, at least one of the legs can be movingly coupled to the adjuster frame.

The present invention is further directed toward a method for supporting the table top assembly relative to the surface with a leg assembly that extends between the table top assembly and the surface, the leg assembly including a first leg and a second leg that are coupled to one another, (i) the first leg including a first leg top that is coupled to the table top assembly, a first leg bottom that is positioned adjacent to the surface, and a first leg body that extends between the first leg top and the first leg bottom, and (ii) the second leg including a second leg top that is coupled to the table top assembly, a second leg bottom that is positioned adjacent to the surface, and a second leg body that extends between the second leg top and the second leg bottom; and wherein the second leg bottom includes a pair of fork members that are coupled to the second leg body, the fork members being positioned relative to one another to provide a pair of spaced apart contact points along the surface, the fork members having a fork length that is at least approximately five inches.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Embodiments of the present invention are described herein in the context of a massage device including a table top assembly that supports a person receiving a therapeutic treatment, and a leg assembly that supports the table top assembly relative to a surface, the leg assembly enabling easy and close access to at least one end of the table top assembly for a person administering the therapeutic treatment. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same or similar nomenclature and/or reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1A:
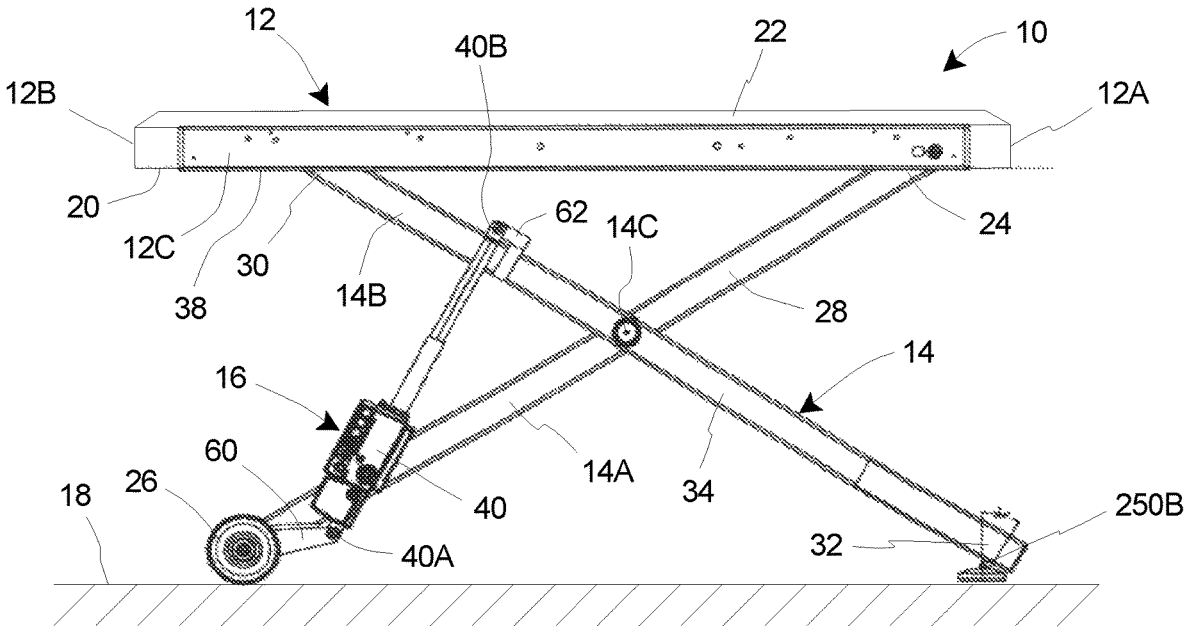
FIG. 1A is a simplified side view of an embodiment of a massage device having features of the present invention, the massage device including a table top assembly and a leg assembly that supports the table top assembly, the table top assembly being positioned in a first position.

FIG. 1A is a simplified side view of an embodiment of a massage device 10, i.e. a massage table, having features of the present invention. In this embodiment, the massage device 10 includes a table top assembly 12, a leg assembly 14 including a first leg 14A and a second leg 14B that are movably coupled to one another, and an adjuster assembly 16. The design of these components can be varied to achieve the desired shape, weight, strength and adjustability, comfort and accessibility characteristics of the massage device 10. Additionally and/or alternatively, the massage device 10 can include more components or fewer components than what is specifically noted herein.

It is further noted that although the massage device 10 illustrated herein is a massage table, the invention is equally applicable to another type of table or piece of furniture where quick, easy and reliable height adjustment is desirable, and where easy and close access to at least one end of the piece of furniture is also desirable.

As an overview, in certain embodiments, the leg assembly 14 is uniquely designed to enable easy, convenient and close access to at least one end of the table top assembly 12 of the massage device 10 for a person who is providing a therapeutic treatment to a person who is positioned on the massage device 10. In particular, as illustrated herein, at least one of the legs 14A, 14B of the leg assembly 14 includes a unique forked design toward a base or bottom of the leg 14A, 14B to enable such easy, convenient and close access to the end of the table top assembly 12. The forked design for at least one of the legs 14A, 14B of the leg assembly 14 is configured to provide two spaced apart contact points along a surface 18, e.g., a floor or the ground, for the at least one leg 14A, 14B. The spacing between the contact points is sufficient such that the person providing the therapeutic treatment can position their feet between the two contact points established by the individual leg 14A, 14B to gain easy and close access to the at least one end of the table top assembly 12.

Figure 1B:
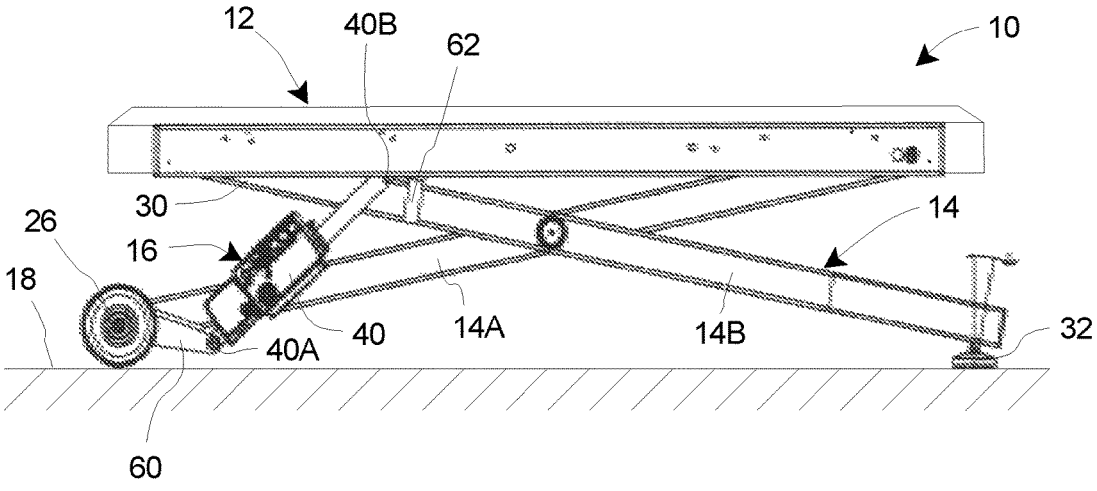
FIG. 1B is another simplified side view of the massage device illustrated in FIG. 1A, the table top assembly being positioned in a second position.

Additionally, in some embodiments, the leg assembly 14 is adjustable via the adjuster assembly 16 so that a height of the table top assembly 12 can be quickly, easily and quietly adjusted relative to the surface 18. In particular, the leg assembly 14 can be selectively adjusted by the adjuster assembly 16 so that the table top assembly 12 can be moved up and down between a first (upper) position (as illustrated in FIG. 1A) and a second (lower) position (as illustrated in FIG. 1B) relative to the surface 18. Moreover, in certain embodiments, the leg assembly 14 can be adjusted to position the table top assembly 12 relative to the surface 18 anywhere along the continuum between the first position and the second position.

The table top assembly 12 provides a surface for a person to rest on during a massage. The design of the table top assembly 12 can be varied. As illustrated in this embodiment, the table top assembly 12 can be generally rectangular-shaped, including a first end 12A, an opposed second end 12B, a first side 12C, and an opposed second side (not shown). Alternatively, for example, the table top assembly 12 can be another shape, such an oval shape, an oblong shape, or a rectangular shape with one or more rounded corners.

It should be noted that the use of the terms "first end", "second end", "first side" and "second side" is merely for ease of discussion, and either of the ends 12A, 12B can be referred to as the first end and/or the second end, and either of the sides 12C can be referred to as the first side and/or the second side.

In one embodiment, the table top assembly 12 includes a table frame 20, a pad (not shown), and a covering 22. Alternatively, for example, the table top assembly 12 can be made without the pad and/or without the covering 22.

The table frame 20 supports the person receiving the massage when the person is positioned on the massage device 10. The table frame 20 is generally rigid and can be made of a rigid material such as wood, aluminum, steel, plastic or other suitable materials. In alternative, non-exclusive embodiments, the table frame 20 has a thickness of approximately 0.2, 0.3, 0.4, 0.5, 0.6, 0.7, 0.8, or 1 inches. However, other thicknesses can be utilized.

The pad is secured to and can be positioned substantially on top of the table frame 20. Additionally, the pad provides a cushion for the comfort of the person resting on the massage device 10. Non-exclusive examples of suitable materials for the pad include foam, memory foam, fleece pads, etc.

The covering 22 secures the pad to the table frame 20 and provides a protective covering for the pad. Non-exclusive examples of suitable materials for the covering 22 include leather, plastic, vinyl and cloth.

In certain embodiments, the table top assembly 12 can further include a headrest (not illustrated) which provides a place to rest the head of the person receiving the massage. In one embodiment, the headrest can be selectively attached to one end of the table top assembly 12, e.g., the first end 12B of the table top assembly 12. Alternatively, in another embodiment, the headrest can be integrated within the table top assembly 12. In some applications, it can be preferable to enable the desired easy, convenient and close access for the treatment provider at the end of the table top assembly 12 that includes the headrest, or where the person receiving the therapeutic treatment is most likely to position their head.

The leg assembly 14 extends between the table top assembly 12 and the surface 18 to maintain the table top assembly 12 positioned above and away from the surface 18. The design of the leg assembly 14 can be varied to suit the specific requirements of the massage device 10. In the embodiment illustrated in FIG. 1A, the leg assembly 14 includes the first leg 14A, the second leg 14B, and a leg attacher 14C that pivotably couples, e.g., directly couples, the first leg 14A and the second leg 14B. As illustrated, the leg assembly 14 provides scissors-type movement between the first leg 14A and the second leg 14B when the table top assembly 12 is being moved between the first position and the second position. Further, as illustrated in this embodiment, the table top assembly 12 can be maintained in a substantially horizontal orientation, i.e. substantially parallel to the surface 18, at all times during movement between the first position and the second position. Alternatively, the leg assembly 14 can be designed to provide a different type of relative movement between the first leg 14A and the second leg 14B when the table top assembly 12 is moved between the upper position and the lower position. Still alternatively, the leg assembly 14 can be designed to include more than two or fewer than two legs.

It is noted that the use of the terms "first leg" and "second leg" is merely for ease of discussion, and either of the legs 14A, 14B can be referred to as the first leg and/or the second leg. Additionally, it is appreciated that the specific designs of the first leg 14A and the second leg 14B, as illustrated and described herein, can be varied to suit the specific requirements of the massage device 10 and/or the leg assembly 14.

The first leg 14A includes a first leg top 24, a first leg bottom 26, and a first leg body 28. As illustrated in this embodiment, the first leg top 24 can be fixedly coupled to the adjuster assembly 16 and/or to the table top assembly 12. In certain alternative embodiments, the first leg top 24 can be movingly (pivotably) coupled to the adjuster assembly 16 and/or to the table top assembly 12.

The first leg bottom 26 is positioned adjacent to and/or in contact with the surface 18. In the embodiment illustrated in FIG. 1A, the first leg bottom 26 is adapted to move relative to the surface 18 when the table top assembly 12 is being moved between the first position and the second position. In alternative embodiments, the first leg bottom 26 can be designed to maintain a substantially static position relative to the surface 18 when the table top assembly 12 is moved between the first position and the second position.

The first leg body 28 extends at an angle between the first leg top 24 and the first leg bottom 26. Further, in some embodiments, the first leg body 28 can be slightly curved to provide improved strength characteristics. In certain embodiments, the first leg body 28 is substantially cylindrical tube-shaped, and the first leg body 28 can be made from a substantially rigid material such as metal or aluminum. Alternatively, the first leg body 28 can have a different design and/or can be made from a different material.

The second leg 14B includes a second leg top 30, a second leg bottom 32, and a second leg body 34. As illustrated in this embodiment, the second leg top 30 can be movingly coupled to the adjuster assembly 16 and/or to the table top assembly 12. In certain alternative embodiments, the second leg top 30 can be fixedly coupled to the adjuster assembly 16 and/or to the table top assembly 12.

The second leg bottom 32 is positioned adjacent to and/or in contact with the surface 18. In the embodiment illustrated in FIG. 1A, the second leg bottom 32 maintains substantially static contact with the surface 18 at all times, even during movement of the table top assembly 12 between the first position and the second position. In alternative embodiments, the second leg bottom 32 can be designed to move relative to the surface 18 when the table top assembly 12 is moved between the first position and the second position.

The second leg body 34 extends at an angle between the second leg top 30 and the second leg bottom 32. Further, in some embodiments, the second leg body 34 can be slightly curved to provide improved strength characteristics. In certain embodiments, the second leg body 34 is substantially cylindrical tube-shaped, and the second leg body 34 can be made from a substantially rigid material such as metal or aluminum. Alternatively, the second leg body 34 can have a different design and/or can be made from a different material.

In summary, in certain alternative embodiments, at least one of the legs 14A, 14B is movingly coupled to the adjuster assembly 16 and/or to the table top assembly 12; and at least one of the legs 14A, 14B is adapted to move relative to the surface 18 when the table top assembly 12 is being moved between the first position and the second position.

The leg attacher 14C movably, e.g., pivotally and/or slidingly, secures the first leg 14A to the second leg 14B. In the embodiment illustrated in FIG. 1A, the leg attacher 14C pivotally attaches the first leg 14A to the second leg 14B while still allowing a scissors-type movement between the first leg 14A and the second leg 14B when the table top assembly 12 is moved between the first position and the second position. In this embodiment, the leg attacher 14C includes a screw or pin that extends through each of a first leg aperture (not shown) and a second leg aperture 336 (illustrated in FIG. 3A), and a plurality of nuts and washers to secure and maintain the screw or pin within the first leg aperture and the second leg aperture 336. As provided herein, the leg attacher 14C allows the first leg 14A and the second leg 14B to pivot relative to one another. Alternatively, the leg attacher 14C can have a different design. Additionally and/or alternatively, in one embodiment, the first leg 14A can include a first leg slot (not illustrated) and/or the second leg 14B can include a second leg slot (not illustrated). In such embodiment, the leg attacher 14C can extend through or be positioned within the first slot and/or the second slot to enable the legs 14A, 14B to slide and/or pivot relative to one another.

Further, as shown, the leg attacher 14C can be positioned so that the first leg 14A is secured to the second leg 14B along the first leg body 28 between the first leg top 24 and the first leg bottom 26. For example, in one embodiment, as illustrated in FIG. 1A, the first leg 14A can be secured to the second leg 14B by the leg attacher 14C along the first leg body 28 approximately half way between the first leg top 24 and the first leg bottom 26. Alternatively, the leg attacher 14C can be positioned so that the first leg 14A is secured to the second leg 14B at a different point along the first leg body 28 between the first leg top 24 and the first leg bottom 26.

Similarly, as shown, the leg attacher 14C can be positioned so that the second leg 14B is secured to the first leg 14A along the second leg body 34 between the second leg top 30 and the second leg bottom 32. For example, in one embodiment, as illustrated in FIG. 1A, the second leg 14B can be secured to the first leg 14A by the leg attacher 14C along the second leg body 34 approximately half way between the second leg top 30 and the second leg bottom 32. Alternatively, the leg attacher 14C can be positioned so that the second leg 14B is secured to the first leg 14A at a different point along the second leg body 34 between the second leg top 30 and the second leg bottom 32.

The adjuster assembly 16 adjusts the position of the table top assembly 12 between the first position and the second position. Additionally, the adjuster assembly 16 can adjust the position of the table top assembly 12 to be anywhere along the continuum between the first position and the second position to suit the comfort of the person receiving the therapeutic treatment and/or to suit the comfort of the person providing the therapeutic treatment. Further, in certain embodiments, as noted above, the table top assembly 12 can be maintained in a substantially horizontal orientation, i.e. substantially parallel to the surface 18, at all times during movement between the first position and the second position. In some such embodiments, the adjuster assembly 16 can have sufficient strength such that the table top assembly 12 can be moved between the first position and the second position even when a person is positioned on the table top assembly 12.

The design of the adjuster assembly 16 can be varied to suit the specific requirements of the massage device 10 and/or the leg assembly 14. In some embodiments, as will be described in greater detail below, the adjuster assembly 16 includes an adjuster frame 38 and an adjuster 40. In particular, as illustrated in FIG. 1A, the adjuster frame 38 can be secured to and/or positioned substantially adjacent to the table frame 20 of the table top assembly 12, and the adjuster 40 can be coupled to and can extend between the first leg 14A and the second leg 14B of the leg assembly 14. Alternatively, the adjuster assembly 16 can have a different design and/or can be positioned in a different manner than is illustrated in FIG. 1A.

FIG. 1B is another simplified side view of the massage device 10 illustrated in FIG. 1A. In particular, as noted above, FIG. 1B illustrates that the legs 14A, 14B of the leg assembly 14 have been moved relative to one another such that the table top assembly 12 is positioned in the second position relative to the surface 18.

More specifically, in this embodiment, as shown in FIG. 1B, the first leg bottom 26 of the first leg 14A has moved relative to the surface 18, and the second leg top 30 of the second leg 14B has moved relative to the table top assembly 12, as the table top assembly 12 has moved from the first position to the second position relative to the surface 18. Additionally, as noted above, the first leg 14A and the second leg 14B have pivoted relative to one another during movement between the first position and the second position, thus changing the angle between the first leg 14A and the second leg 14B.

In comparing what is shown in FIGS. 1A and 1B, it is appreciated that the specific relative positioning of the legs 14A, 14B, and the specific positioning of the table top assembly 12 relative to the surface 18 can be varied when the table top assembly 12 is alternatively positioned in the first position and the second position. For example, in certain non-exclusive embodiments, the first leg bottom 26 and the second leg bottom 32 can be positioned between approximately fifty inches and sixty inches apart along the surface 18 when the table top assembly 12 is in the first position; and the first leg bottom 26 and the second leg bottom 32 can be positioned between approximately fifty-five inches and sixty-five inches apart along the surface 18 when the table top assembly 12 is in the second position. Stated another way, in such embodiments, the first leg bottom 26 and the second leg bottom 32 can be moved approximately five inches relative to one another along the surface 18 when the table top assembly 12 is moved between the first position and the second position. Alternatively, the spacing between the first leg bottom 26 and the second leg bottom 32 along the surface 18 can be different than (i.e. greater than or less than) the specific distances noted above when the table top assembly 12 is in the first position and/or when the table top assembly 12 is in the second position. Still alternatively, the first leg bottom 26 and the second leg bottom 32 can be moved more than five inches or less than five inches relative to one another along the surface 18 when the table top assembly 12 is moved between the first position and the second position.

Additionally, in some non-exclusive embodiments, the table top assembly 12 can be moved between the first position, wherein the table top assembly 12 is positioned between approximately thirty-four inches and thirty-nine inches above the surface 18, and the second position, wherein the table top assembly 12 is positioned between approximately fifteen and twenty inches above the surface 18. Stated another way, in such embodiments, the table top assembly 12 can have a vertical range of motion of approximately nineteen inches between the first position and the second position. Alternatively, the position of the table top assembly 12 relative to the surface 18 can be adjusted such that each of the first position and the second position are greater than or less than the distances stated above. Still alternatively, the table top assembly 12 can have a vertical range of motion that is greater than or less than approximately nineteen inches.

Figure 2:
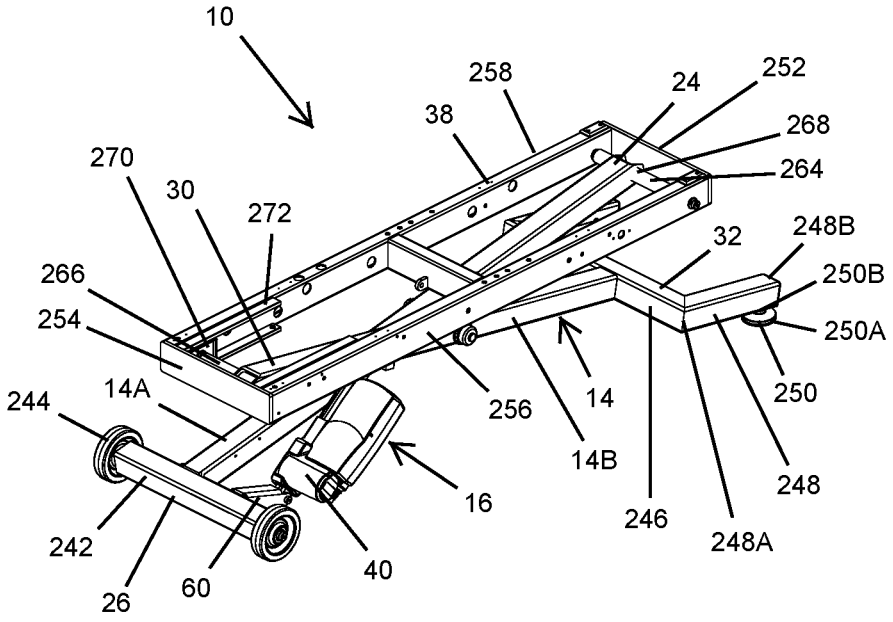
FIG. 2 is a top perspective view of a portion of the massage device illustrated in FIG. 1A.

FIG. 2 is a top perspective view of a portion of the massage device 10 illustrated in FIG. 1A. In particular, FIG. 2 is a perspective view of the massage device 10 with the table top assembly 12 removed for purposes of clarity. Moreover, FIG. 2 more clearly illustrates certain additional features and aspects of the leg assembly 14 and the adjuster assembly 16.

As illustrated in this embodiment, the first leg bottom 26 includes a substantially cylindrical tube-shaped first cross member 242 and a pair of circular rollers 244 that are secured at or near either end of the first cross member 242. The rollers 244 are designed to engage the surface 18 (illustrated in FIG. 1A) and to allow the first leg 14A to move relative to the surface 18 when the table top assembly 12 (illustrated in FIG. 1A) is moved between the first position and the second position. Alternatively, the first leg bottom 26 can be configured to maintain a substantially static contact point between the first leg 14A and the surface 18.

Additionally, in this embodiment, the first leg top 24 is fixedly coupled to the adjuster frame 38 of the adjuster assembly 16. Thus, in this embodiment, the first leg top 24 is also fixedly coupled to the table top assembly 12, i.e. near the first end 12A of the table top assembly 12, via the adjuster frame 38. In certain alternative embodiments, the first leg top 24 can be movingly coupled to the adjuster frame 38 of the adjuster assembly 16.

Further, in this embodiment, the second leg bottom 32 includes a generally forked design that establishes two spaced apart contact points between the second leg bottom 32 and the surface 18. More specifically, as shown in FIG. 2, the second leg bottom 32 can include a tube-shaped second cross member 246 and a pair of fork members 248 that extend downward at an angle from the second cross member 246. Each of the pair of fork members 248 includes a proximal end 248A that is coupled to the second cross member 246 and a distal end 248B that is positioned near or substantially adjacent to the surface 18. Additionally, in this embodiment, the second leg bottom 32 further includes a pair of circular disk-shaped base members 250, with one base member 250 being secured at or near the distal end 248B of each of the fork members 248. The base members 250 are designed to maintain substantially static contact points between the second leg 14B and the surface 18 at all times, even during movement of the table top assembly 12 between the first position and the second position. Alternatively, the second leg bottom 32 can be configured to allow the second leg 14B to move relative to the surface 18 when the table top assembly 12 is moved between the first position and the second position. Still alternatively, the second leg bottom 32 can be designed without the second cross member 246, and the fork members 248 can be angled away from one another as they extend downward toward the surface 18. In such alternative design, the fork members 248 can still provide a pair of spaced apart contact points with the surface 18 via the base members 250 that are secured thereto.

In certain embodiments, each base member 250 can include a substantially disk-shaped base 250A that is configured to contact the surface 18, and a linkage bar 250B (illustrated more clearly in FIG. 1A) that is coupled to and extends between the base 250A and the distal end 248B of the respective fork member 248. In some such embodiments, the linkage bar 250B is movably coupled to the distal end 248B of the fork member 248 to better enable the base 250A to be positioned flat along the surface 18.

As provided herein, the unique design of the second leg bottom 32, i.e. the forked design, enables easy, convenient and close access to the first end 12A (illustrated in FIG. 1A) of the table top assembly 12 of the massage device 10 to a person who is providing a therapeutic treatment to a person who is positioned on the massage device 10. More specifically, the person providing the therapeutic treatment can easily position their feet between the fork members 248 to gain close access to the first end 12A of the table top assembly 12. The distal ends 248B of the fork members 248 are spaced apart from one another so as to provide the pair of spaced apart contact points with the surface 18 via the base members 250 that are secured thereto. In certain non-exclusive alternative embodiments, the distal ends 248B of the fork members 248 can be spaced apart from one another by at least approximately ten inches, twelve inches, fourteen inches, sixteen inches, eighteen inches, twenty inches, twenty-two inches or twenty-four inches, twenty-six inches, twenty-eight inches or thirty inches. Alternatively, the distal ends 248B of the fork members 248 can be spaced apart from one another by greater than thirty inches or less than ten inches.

Additionally, in certain applications, it can be preferred to have the head of the person positioned on the massage device 10 near the first end 12A of the table top assembly 12 so that the treatment-provider can have close and easy access to the head of the treatment-receiver.

Still further, in this embodiment, the second leg top 30 is movingly coupled to the adjuster frame 38 of the adjuster assembly 16. Thus, in this embodiment, the second leg top 30 is also movingly coupled to the table top assembly 12, i.e. near the second end 12B of the table top assembly 12, via the adjuster frame 38. In certain alternative embodiments, the second leg top 30 can be fixedly coupled to the adjuster frame 38 of the adjuster assembly 16.

As provided herein, the adjuster assembly 16 adjusts the position of the table top assembly 12 relative to the surface 18 between the first position and the second position, or anywhere along the continuum between the first position and the second position. The design of the adjuster assembly 16 can be varied to suit the specific requirements of the massage device 10. As provided above, in certain embodiments, the adjuster assembly 16 includes the adjuster frame 38 and the adjuster 40.

As noted above, in the embodiment illustrated herein, the adjuster frame 38 is secured to and/or positioned substantially adjacent to the table frame 20 (illustrated in FIG. 1A) of the table top assembly 12. In this embodiment, the adjuster frame 38 is generally rectangle-shaped, including a first frame end 252, an opposed second frame end 254, a first frame side 256, and an opposed second frame side 258. Alternatively, the adjuster frame 38 can be designed with a different shape. Additionally, the adjuster frame 38 is generally rigid and can be made of a rigid material such as wood, aluminum, metal, plastic or other suitable materials.

Further, as noted above, the adjuster 40 is coupled to and extends between the first leg 14A and the second leg 14B of the leg assembly 14. In certain embodiments, the adjuster 40 is an actuator, e.g., a hydraulic actuator that is electrically activated, that utilizes piston-like movement to move the table top assembly 12 between the first position and the second position. Alternatively, the adjuster 40 can have a different design. For example, the adjuster 40 can be an electronic actuator, a pneumatic actuator or another type of actuator.

Additionally, as illustrated, the adjuster 40 acts primarily in the push mode. For example, in such embodiment, the adjuster 40 acts in push mode when the adjuster 40 moves, i.e. lifts, the table top assembly 12 in a generally upward direction, e.g., from the second position toward the first position. Thus, the adjuster 40 moves, e.g., pushes and/or expands, in a generally linear direction to move the table top assembly 12 vertically upward from the second position toward the first position. Conversely, the adjuster 40 moves, e.g., pulls and/or contracts, in a generally linear direction to move the table top assembly 12 vertically downward from the first position toward the second position.

It should be noted that having the adjuster 40 move in a generally linear fashion inhibits damage to the adjuster 40 that may be caused by any non-linear movement that may generate undesired torque and/or other forces on the adjuster 40. Additionally, in certain embodiments, the adjuster 40 can be somewhat stronger when utilized in push mode as a result of the smaller surface area of the piston due to the presence of a piston shaft being connected to one side of the piston.

In certain alternative embodiments, the adjuster 40 can be positioned in a different manner, can have a different design and/or can act primarily in a different mode, e.g., in pull mode.

Returning briefly to FIG. 1A, in this embodiment, the adjuster 40 is coupled to the first leg 14A, e.g., at or near the first leg bottom 26, with a first adjuster connector 60, and the adjuster 40 is coupled to the second leg 14B, e.g., along the second leg body 34 between the second leg top 30 and the leg attacher 14C, with a second adjuster connector 62. As shown in FIGS. 1A and 1B, in some embodiments, the first adjuster connector 60 can include a linkage assembly that extends between a first adjuster end 40A and the first leg bottom 26. More specifically, in such embodiments, the first adjuster connector 60 can be pivotally connected to the first adjuster end 40A, and can also be pivotally connected to the first leg bottom 26. With such design, the first adjuster connector 60 enables the angle of the adjuster 40 to change relative to the first leg 14A during movement between the first position and the second position. Alternatively, the adjuster 40 can be coupled to the first leg 14A in a different manner and/or in a different location than what is illustrated in the Figures.

Additionally, as also shown in FIGS. 1A and 1B, in some embodiments, the second adjuster connector 62 can also include a linkage assembly that extends between a second adjuster end 40B and the second leg body 34. More specifically, in such embodiments, the second adjuster connector 62 can be pivotally connected to the second adjuster end 40B, and can also be pivotally connected to the second leg body 34. With such design, the second adjuster connector 62 enables the angle of the adjuster 40 to change relative to the second leg 14B during movement between the first position and the second position. Alternatively, the adjuster 40 can be coupled to the second leg 14B in a different manner and/or in a different location than what is illustrated in the Figures.

Returning again to FIG. 2, as shown in this embodiment, the first adjuster connector 60 can couple the adjuster 40 to the first cross member 242 of the first leg 14A.

Additionally, as shown, the leg assembly 14 can further include a first leg attacher 264 and a second leg attacher 266 that couple the first leg 14A and the second leg 14B, respectively, to the adjuster frame 38.

The first leg attacher 264 fixedly secures the first leg 14A to the adjuster frame 38. More particularly, in this embodiment, the first leg attacher 264 is substantially cylindrical tube-shaped and extends between and fixedly secures the first leg 14A to the first frame side 256 and the second frame side 258 near the first frame end 252. Additionally, as shown, the first leg attacher 264 extends through a first attacher aperture 268 at or near the first leg top 24 that allows the first leg 14A to pivot and/or rotate about the first leg attacher 264 during movement of the table top assembly 12 between the first position and the second position. Alternatively, the first leg attacher 264 can have a different shape, a different positioning, and/or can secure the first leg 14A to the adjuster frame 38 in a different manner.

The second leg attacher 266 movingly, e.g., slidingly, couples the second leg 14B to the adjuster frame 38. More particularly, in this embodiment, the second leg attacher 266 is connected to a pair of sliders 270 (only one is visible in FIG. 2) that are received by and move within a pair of slider receivers 272. The slider receivers 272 are mounted on an inner surface of the first frame side 256 and the second frame side 258 of the adjuster frame 38, respectively, near the second frame end 254. Movement of each of the sliders 270 along and/or relative to the adjuster frame 38 is guided by one of the slider receivers 272. With this design, each of the sliders 270 is constrained to move back and forth along a substantially horizontal axis within one of the slider receivers 272 such that the second leg top 30 can move, e.g., slide, relative to the adjuster frame 38 during movement of the table top assembly 12 between the first position and the second position. As shown, the second leg attacher 266 can be substantially cylindrical tube-shaped and extends between and couples the second leg top 30 to each of the sliders 270. Alternatively, the second leg attacher 266 can have a different shape, a different positioning, and/or can couple the second leg 14B to the adjuster frame 38 in a different manner.

It is appreciated that when the table top assembly 12 is positioned at or near the second (lower) position, the sliders 270 will be positioned within the slider receivers 272 very near the second frame end 254; and when the table top assembly 12 is positioned at or near the first (upper) position, the sliders 270 will be positioned within the slider receivers 272 near an end of the slider receivers away from the second frame end 254.

Additionally, it is further appreciated that the adjuster 40 can be activated in any suitable manner. For example, the adjuster 40 can be activated via a foot pedal, a hand-held mechanism, or in another suitable manner.

Figure 3A:
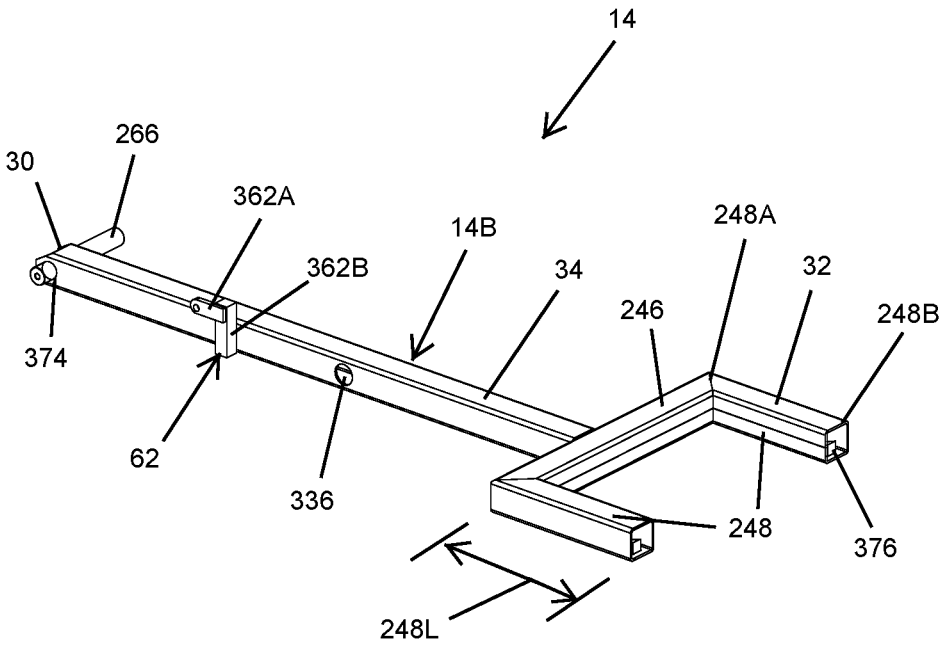
FIG. 3A is a perspective view of a portion of the leg assembly illustrated in FIG. 1A.

FIG. 3A is a perspective view of a portion of the leg assembly 14 illustrated in FIG. 1A. More specifically, FIG. 3A illustrates an embodiment of the second leg 14B, i.e. the forked leg, that forms a part of the leg assembly 14.

Additionally, FIG. 3A also illustrates the second adjuster connector 62 that connects the adjuster 40 (illustrated in FIG. 1A) to the second leg body 34, and the second leg attacher 266 that movingly couples the second leg 14B to the sliders 270 (illustrated in FIG. 2) to enable the second leg top 30 to move relative to the adjuster frame 38 (illustrated in FIG. 1A) during movement of the table top assembly 12 (illustrated in FIG. 1A) between the first position and the second position.

The design of the second leg 14B can be varied to suit the specific requirements of the massage device 10 (illustrated in FIG. 1A) and/or the leg assembly 14. Moreover, as provided herein, the second leg 14B is uniquely designed to enable easy, convenient and close access to the first end 12A (illustrated in FIG. 1A) of the table top assembly 12 of the massage device 10 for a person who is providing a therapeutic treatment to a person who is positioned on the massage device 10.

As illustrated, the second leg 14B includes the second leg top 30, the second leg bottom 32 and the second leg body 34. As noted above, in certain embodiments, the second leg top 30 is adapted to be movingly, e.g., slidingly, coupled to the adjuster frame 38 (illustrated in FIG. 1A) via the second leg attacher 266. In particular, as shown, the second leg top 30 can include a second attacher aperture 374 that is configured to receive the second leg attacher 266. The second leg attacher 266 extends through the second attacher aperture 374 at or near the second leg top 30 that allows the second leg 14B to pivot and/or rotate about the second leg attacher 266 during movement of the table top assembly 12 between the first position and the second position.

The second leg body 34 extends between the second leg top 30 and the second leg bottom 32. As shown, in this embodiment, the second leg body 34 can be substantially straight, rectangular tube-shaped as it extends between the second leg top 30 and the second leg bottom 32. Alternatively, the second leg body 34 can have a different shape, e.g., the second leg body 34 can be slightly curved and/or the second leg body 34 can be cylindrical tube-shaped.

Additionally, as shown, the second leg body 34 can include the second leg aperture 336 that receives the leg attacher 14C (illustrated in FIG. 1A) for purposes of coupling the second leg 14B to the first leg 14A (illustrated in FIG. 1A).

Further, as noted, FIG. 3A also illustrates the second adjuster connector 62 that connects the adjuster 40 to the second leg body 34. The specific design of the second adjuster connector 62 can be varied. As shown, in some embodiments, the second adjuster connector 62 includes a linkage assembly having a first bracket member 362A and a second bracket member 362B that are movably, e.g., pivotally, coupled to one another. In such embodiments, the first bracket member 362A can be movably, e.g., pivotally, coupled to the adjuster 40, and the second bracket member 362B can be coupled, e.g., fixedly and/or pivotally coupled, to the second leg body 34 of the second leg 14B. With this design, the second adjuster connector 62 enables the angle of the adjuster 40 to change relative to the second leg 14B during movement between the first position and the second position.

In certain embodiments, the second leg bottom 32 is fixedly secured, e.g., by welding, and/or integrally formed with the second leg body 34. As illustrated in this embodiment, the second leg bottom 32 includes the unique forked design including the second cross member 246 and the pair of fork members 248 that are secured to, e.g., by welding, and/or are integrally formed with the second cross member 246, and that extend away from the second cross member 246 at either end of the second cross member 246. Additionally, in certain embodiments, as shown, the leg body 34 and each of the fork members 248 can extend toward the surface 18 in a substantially a common plane.

In one non-exclusive embodiment, each end of the second cross member 246 can be formed at an approximately forty-five degree angle, and the proximal end 248A of each fork member 248 can be formed at an approximately forty-five degree angle, such that the fork members 248 extend away from the second cross member 246 at an angle of approximately ninety degrees. Additionally, in such embodiment, the fork members 248 can extend substantially parallel to the second leg body 34.

Alternatively, the connection between the second cross member 246 and the fork members 248 can be formed in a different manner and/or the fork members 248 can extend away from the second cross member 246 at an angle of greater than or less than approximately ninety degrees. For example, in certain non-exclusive alternative embodiments, the fork members 248 can extend away from the second cross member 246 at an angle of approximately sixty (60), sixty-five (65), seventy (70), seventy-five (75), eighty (80), eighty-five (85), ninety (90), ninety-five (95), one hundred (100), one hundred five (105), one hundred ten (110), one hundred fifteen (115), one hundred twenty (120), one hundred twenty-five (125), one hundred thirty (130), or one hundred thirty-five (135) degrees. The angling of the fork members 248 as they extend away from the second cross member 246 is designed to adjust the spacing between the distal ends 248B of the fork members 248 substantially adjacent to the surface 18, i.e. compared to the spacing between the proximal ends 248A of the fork members 248.

It is understood that the important aspect of the design and positioning of the fork members 248 is that they are configured to provide a pair of spaced apart contact points along the surface 18 (illustrated in FIG. 1A). Additionally, it is further understood that it is desired to have sufficient vertical clearance between the pair of spaced apart contact points along the surface 18 and below the second cross member 246 such that the person providing the therapeutic treatment can easily position their feet within the vertical clearance area. For example, in certain non-exclusive alternative embodiments, it is desired to have the vertical clearance between the contact points along the surface 18 provided by the fork members 248 and below the second cross member 246 be at least approximately two inches, three inches, four inches, five inches or six inches.

Still alternatively, as noted above, in certain embodiments, the second leg bottom 32 can be designed without the second cross member 246. In such embodiments, the fork members 248 can be more directly coupled to the second leg body 34. Further, the fork members 248 can be positioned to be angled away from one another, and angled other than parallel relative to the second leg body 34, as the fork members 248 extend away from the second leg body 34. For example, in some non-exclusive alternative embodiments, each of the fork members 248 can be positioned at an angle of between approximately zero (0) degrees and forty-five (45) degrees relative to the second leg body 34. More specifically, in such embodiments, each of the fork members 248 can be positioned at an angle of approximately zero (0), five (5), ten (10), fifteen (15), twenty (20), twenty-five (25), thirty (30), thirty-five (35), forty (40) or forty-five (45) degrees relative to the second leg body 34. Such angling of the fork members 248 relative to the second leg body 34 can again provide the desired spaced apart contact points for the fork members 248 along the surface 18. More particularly, the angling of the fork members 248 relative to the second leg body 34 enables greater spacing between the distal ends 248B of the fork members 248 than between the proximal ends 248A of the fork members 248.

In some embodiments, the second leg bottom 32 can be made from a substantially rigid material such as metal or aluminum. Alternatively, the second leg bottom 32 can have a different design and/or can be made from a different material.

It is appreciated that although only one leg, i.e. the second leg 14B, is illustrated and described herein as including the unique forked design, the leg assembly 14 can be configured such that both legs 14A, 14B have a similar forked design. Additionally, it should be appreciated that either or both of such forked legs can be configured to move relative to the surface 18 (illustrated in FIG. 1A) during movement of the table top assembly 12 between the first position and the second position.

Additionally illustrated in FIG. 3A are a pair of base member couplers 376, with one base member coupler 376 being coupled at or near a distal end of each of the fork members 248. Each of the base member couplers 376 is configured to receive one of the base members 250 (illustrated in FIG. 2) that enable the stable, static contact between the second leg 14A and the surface 18 in this embodiment. Stated in another manner, the base member couplers 376 are configured to couple the base members 250 to the second leg bottom 32 of the second leg 14B.

The particular dimensions of the various components of the second leg 14B can be varied to suit the requirements of the massage device 10 and/or the leg assembly 14. For example, in certain non-exclusive embodiments, the second leg 14B can have an overall length from the second leg top 30 to the distal end of the second leg bottom 32 of between approximately fifty inches and sixty-five inches. Additionally, the second leg body 34 can have a length from the second leg top 30 to the second cross member 246 of the second leg bottom 32 of between approximately forty inches and fifty inches. Further, the second cross member 246 can have a length from end to end of between approximately twenty inches and twenty-five inches.

Still further, the fork members 248 of the second leg bottom 32 can have a fork length 248L of between approximately five inches and twenty inches.

For example, in certain non-exclusive alternative embodiments, the fork members 248 can have a fork length 248L of at least approximately five inches, eight inches, ten inches, twelve inches, fifteen inches, eighteen inches or twenty inches. It is appreciated that the fork length 248L of the fork members 248 is directly related to the amount of vertical clearance that can be provided between the contact points of the forked leg assembly 14 and below the second cross member 246. Thus, the greater the fork length 248L of the fork members 248, the greater the amount of vertical clearance provided for the feet of the treatment-provider. It should further be appreciated that the specific angle of the leg assembly 14 relative to the surface 18 at or near the surface 18 will also impact the amount of vertical clearance that can be provided.

Additionally, the second leg aperture 336 can be positioned along the second leg body 34 between approximately twenty-two inches and twenty-eight inches from the second leg top 30. Further, the second adjuster connector 62, i.e. the second bracket member 362B, can be coupled to the second leg body 34 between approximately twelve inches and eighteen inches from the second leg top 30.

Alternatively, any of the dimensions of the components of the second leg 14B and the relative positioning of any components therein or coupled thereto can be different than, i.e. greater than or less than, the specific dimensions as noted above.

Figure 3B:
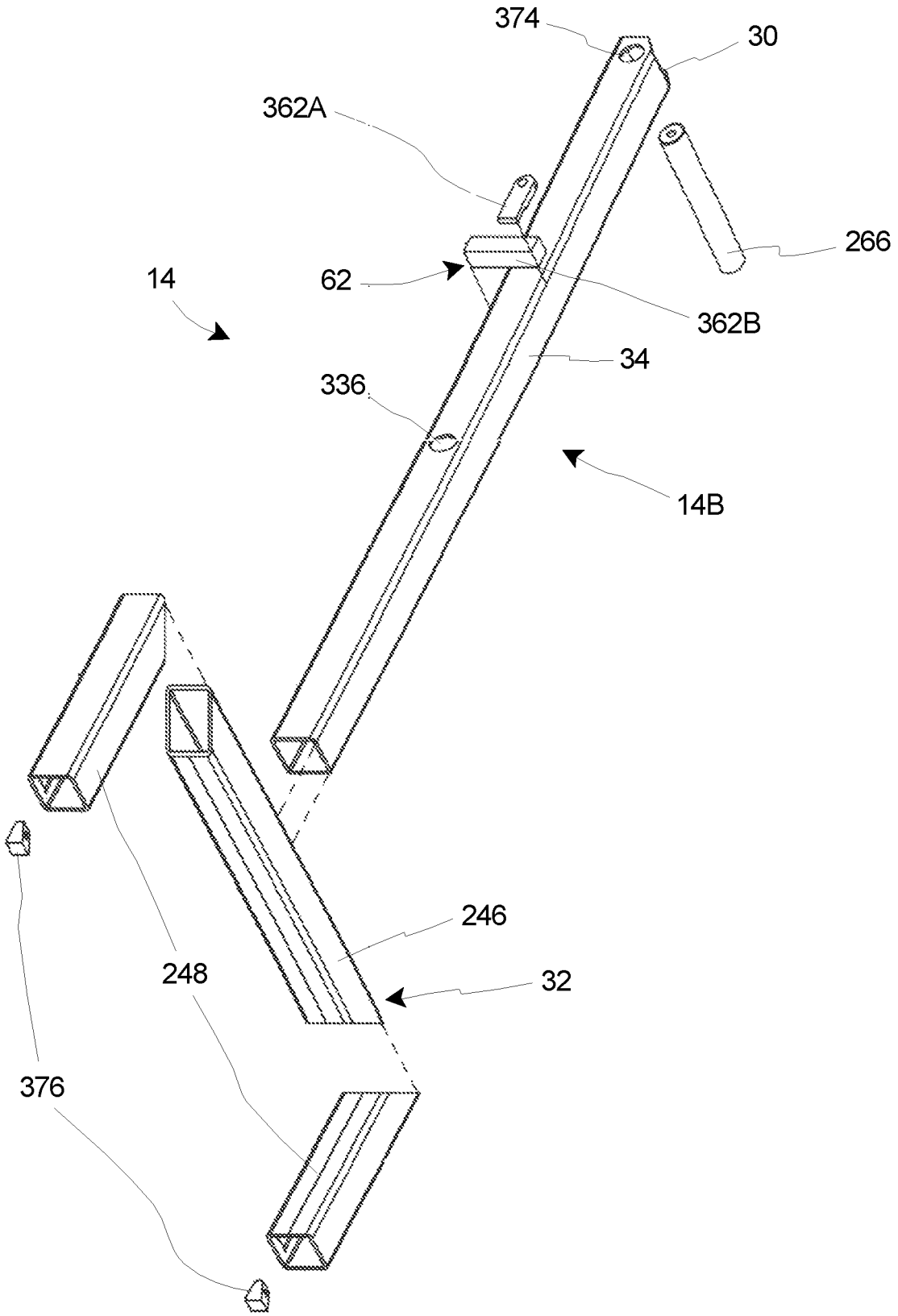
FIG. 3B is an exploded perspective view of the portion of the leg assembly illustrated in FIG. 3A.

FIG. 3B is an exploded perspective view of the portion of the leg assembly 14 illustrated in FIG. 3A. In particular, FIG. 3B is an exploded perspective view of the second leg 14B, i.e. the forked leg, of the leg assembly 14. More specifically, FIG. 3B again illustrates that the second leg 14B includes the second leg top 30, which includes the second attacher aperture 374; the second leg body 34, which includes the second leg aperture 336; and the second leg bottom 32, which includes the second cross member 246 and the fork members 248. Additionally, FIG. 3B again also illustrates the second leg attacher 266, the second adjuster connector 62 including the first bracket member 362A and the second bracket member 362B, and the pair of base member couplers 376.

It is understood that although a number of different embodiments of the massage device 10 have been illustrated and described herein, one or more features of any one embodiment can be combined with one or more features of one or more of the other embodiments, provided that such combination satisfies the intent of the present invention.

While a number of exemplary aspects and embodiments of a massage device 10 have been discussed herein above, those of skill in the art will recognize certain modifications, permutations, additions and sub-combinations thereof. It is therefore intended that the massage device 10 shall be interpreted to include all such modifications, permutations, additions and sub-combinations as are within their true spirit and scope, and no limitations are intended to the details of construction or design herein shown.

What is claimed is:

1. A massage device including a table top assembly that supports a use above a surface, the massage device comprising:

a leg assembly configured to move the table top assembly vertically between a first position and a second position relative to the surface, the leg assembly extending between the table top assembly and the surface, the leg assembly including a first leg and a second leg that are movably coupled to one another to provide scissors-type movement between the first leg and the second leg, (i) the first leg including a first leg top that is coupled to the table top assembly, a first leg bottom that is positioned adjacent to the surface, and a first leg body that extends between the first leg top and the first leg bottom, and (ii) the second leg including a second leg top that is coupled to the table top assembly, a second leg bottom that is positioned adjacent to the surface, and a second leg body that extends between the second leg top and the second leg bottom; and wherein the second leg bottom includes a pair of fork members, each of the fork members including a proximal end that is coupled to the second leg body and a distal end that cantilevers away from the second leg body and is positioned adjacent to the surface, the fork members being spaced apart a gap from one another adjacent to the surface to provide a pair of spaced apart contact points along the surface so that a person providing a therapeutic treatment to the user can position their feet along the surface and within the gap and between the pair of spaced apart contact points along the surface, the fork members having a fork length that is at least approximately five inches.

2. The massage device of claim 1 where the fork members extend at an angle of between approximately zero degrees and forty-five degrees relative to the second leg body.

3. The massage device of claim 1 wherein the second leg bottom further includes a second cross member that is connected to the second leg body, and wherein the pair of fork members are spaced apart from one another and extend away from the second cross member near either end of the second cross member.

4. The massage device of claim 3 wherein the pair of fork members extend away from the second cross member at an angle of between approximately seventy-five degrees and one hundred five degrees.

5. The massage device of claim 3 wherein the pair of fork members extend away from the second cross member at an angle of approximately ninety degrees.

6. The massage device of claim 1 wherein the second leg bottom further includes a pair of base members, with one base member being coupled to each of the fork members at the distal end of the fork member, and wherein each of the base members is substantially disc-shaped to maintain a static contact point between the second leg and the surface.

7. The massage device of claim 1 wherein the first leg body includes a first leg aperture, and the second leg body includes a second leg aperture; and wherein the leg assembly further includes a leg attacher that extends through the first leg aperture and the second leg aperture to movingly couple the first leg and the second leg to provide scissors-type movement between the first leg and the second leg.

8. The massage device of claim 1 wherein at least one of the legs is movingly coupled to the table top assembly; and wherein at least one of the legs is configured to move relative to the surface when the table top assembly moves between the first position and the second position.

9. The massage device of claim 1 further comprising an adjuster assembly that adjusts the position of the table top assembly relative to the surface between the first position and the second position.

10. The massage device of claim 9 wherein the adjuster assembly includes an adjuster that is coupled to and extends between the first leg and the second leg; and wherein the massage device further comprises a first adjuster connector that movably couples a first adjuster end of the adjuster to the first leg, and a second adjuster connector that movably couples a second adjuster end of the adjuster to the second leg.

11. The massage device of claim 10 wherein the adjuster is an actuator that utilizes piston-like movement to move the table top assembly between the first position and the second position.

12. The massage device of claim 10 wherein the first adjuster connector enables a first angle of the adjuster to change relative to the first leg during movement between the first position and the second position, and wherein the second adjuster connector enables a second angle of the adjuster to change relative to the second leg during movement between the first position and the second position.

13. The massage device of claim 9 wherein the adjuster assembly includes an adjuster frame that is coupled to and positioned adjacent to the table top assembly, and wherein the leg assembly includes a first leg attacher that attaches the first leg to the adjuster frame, and a second leg attacher that attaches the second leg to the adjuster frame.

14. The massage device of claim 13 wherein at least one of the legs is movingly coupled to the adjuster frame.

15. A method for supporting a user of a massage device above a surface, the massage device including a table top assembly, the method comprising the step of:

supporting the table top assembly relative to the surface with a leg assembly configured to move the table top assembly vertically between a first position and a second position relative to the surface, the leg assembly extending between the table top assembly and the surface, the leg assembly including a first leg and a second leg that are movably coupled to one another to provide scissors-type movement between the first leg and the second leg, (i) the first leg including a first leg top that is coupled to the table top assembly, a first leg bottom that is positioned adjacent to the surface, and a first leg body that extends between the first leg top and the first leg bottom, and (ii) the second leg including a second leg top that is coupled to the table top assembly, a second leg bottom that is positioned adjacent to the surface, and a second leg body that extends between the second leg top and the second leg bottom; and wherein the second leg bottom includes a pair of fork members, each of the fork members including a proximal end that is coupled to the second leg body and a distal end that cantilevers away from the second leg body and is positioned adjacent to the surface, the fork members being spaced apart a gap from one another adjacent to the surface to provide a pair of spaced apart contact points along the surface so that a person providing a therapeutic treatment to the user can position their feet along the surface and within the gap and between the pair of spaced apart contact points along the surface, the fork members having a fork length that is at least approximately five inches.

16. The method of claim 15 wherein the step of supporting includes the second leg bottom further including a second cross member that is connected to the second leg body, wherein the pair of fork members are spaced apart from one another and extend away from the second cross member near either end of the second cross member, and wherein the pair of fork members extend away from the second cross member at an angle of between approximately seventy-five degrees and one hundred five degrees.

17. The method of claim 15 further comprising the step of adjusting the vertical position of the table top assembly relative to the surface between the first position and the second position with an adjuster assembly; and wherein the step of supporting includes at least one of the legs being movingly coupled to the table top assembly, and at least one of the legs being configured to move relative to the surface when the table top assembly moves between the first position and the second position.

18. The method of claim 17 wherein the step of adjusting includes the steps of movably coupling a first adjuster end of an adjuster to the first leg with a first adjuster connector, the first adjuster connector enabling a first angle of the adjuster to change relative to the first leg during movement between the first position and the second position; and movably coupling a second adjuster end of the adjuster to the second leg with a second adjuster connector, the second adjuster connector enabling a second angle of the adjuster to change relative to the second leg during movement between the first position and the second position.

19. The method of claim 17 wherein the step of adjusting includes the steps of positioning an adjuster frame adjacent to the table top assembly, attaching the first leg to the adjuster frame with a first leg attacher, and attaching the second leg to the adjuster frame with a second leg attacher; and wherein at least one of the legs is movingly coupled to the adjuster frame.

* * * * *